US005788011A

United States Patent [19]

Kemmer et al.

[11] Patent Number: 5,788,011

[45] Date of Patent: Aug. 4, 1998

[54] FOLDABLE LADDER

[75] Inventors: Walter Kemmer, Canton; Stewart Murray, Waterford; Tim Kohrman, Warren, all of Mich.

[73] Assignee: ASC Incorporated, Southgate, Mich.

[21] Appl. No.: 689,964

[22] Filed: Aug. 16, 1996

[51] Int. Cl.[6] ..... E06C 9/12

[52] U.S. Cl. ..... 182/96; 182/160

[58] Field of Search ..... 182/96, 91, 93, 182/95, 82, 83, 85, 159, 160; 5/111

[56] References Cited

U.S. PATENT DOCUMENTS

| | | | |
|---|---|---|---|
| 278,301 | 5/1883 | Welsh . | |
| 666,566 | 1/1901 | Sherman | 182/96 |
| 740,460 | 10/1903 | Naylor | 182/159 |
| 772,741 | 10/1904 | O'Leary . | |
| 1,083,939 | 1/1914 | Paterson | 182/96 |
| 1,503,425 | 7/1924 | Martin | 5/111 |
| 1,839,808 | 1/1932 | Sikorsky . | |
| 1,887,301 | 11/1932 | Gordon | 182/96 |
| 2,222,636 | 11/1940 | Strauss . | |
| 2,517,811 | 8/1950 | Torburn | 182/96 |
| 3,025,923 | 3/1962 | Burnstein | 182/96 |
| 3,414,081 | 12/1968 | Wedvik . | |
| 3,575,263 | 4/1971 | Reinhard | 182/160 |
| 4,243,119 | 1/1981 | Rossey | 182/96 |
| 4,245,717 | 1/1981 | Soucy | 182/96 |
| 4,463,829 | 8/1984 | Grin | 182/160 |
| 5,058,843 | 10/1991 | Koster | 248/221.4 |
| 5,339,920 | 8/1994 | Ericksson | 182/96 |

OTHER PUBLICATIONS

Brochure, Peterbilt, "Ultrasleeper", Mar. 1996.

"Overdrive" Magazine, Jul. 1996 issue, p. 32.

*Primary Examiner*—Alvin C. Chin-Shue

*Attorney, Agent, or Firm*—Harness, Dickey & Pierce, P.L.C.

[57] ABSTRACT

Provided is a folding ladder assembly for over-the-road trucks. The folding ladder assembly includes a fixed ladder rail secured to a vertical wall portion of the cab of the over-the-road truck, and a moveable ladder rail interconnected with the fixed ladder rail and positionable between a collapsed, storage position and an extended use position. The folding ladder assembly further includes a ladder stabilizing mechanism disposed at the upper and lower portions of the moveable ladder rail assembly for stabilizing the folding ladder assembly when it is positioned in the extended, use position.

9 Claims, 2 Drawing Sheets

FIG 1
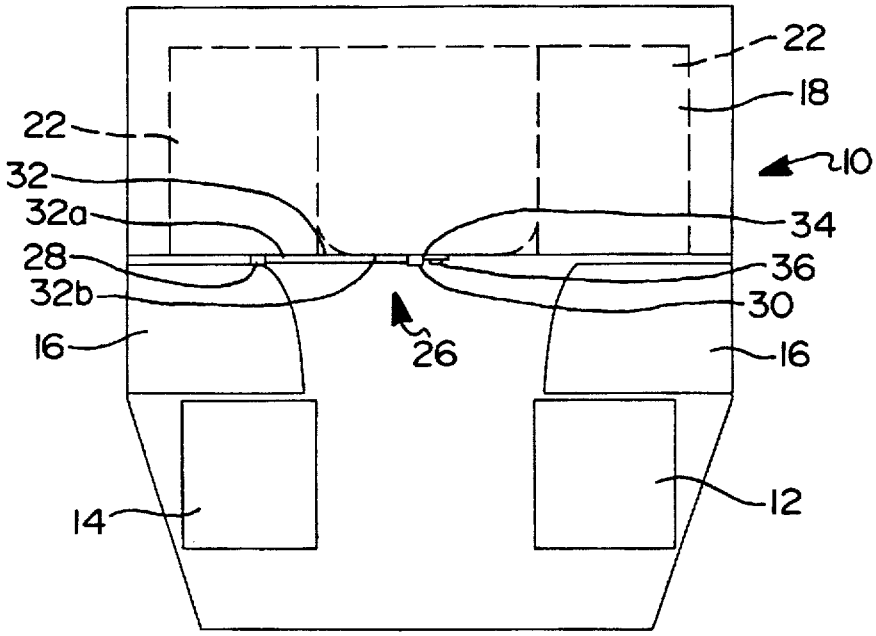
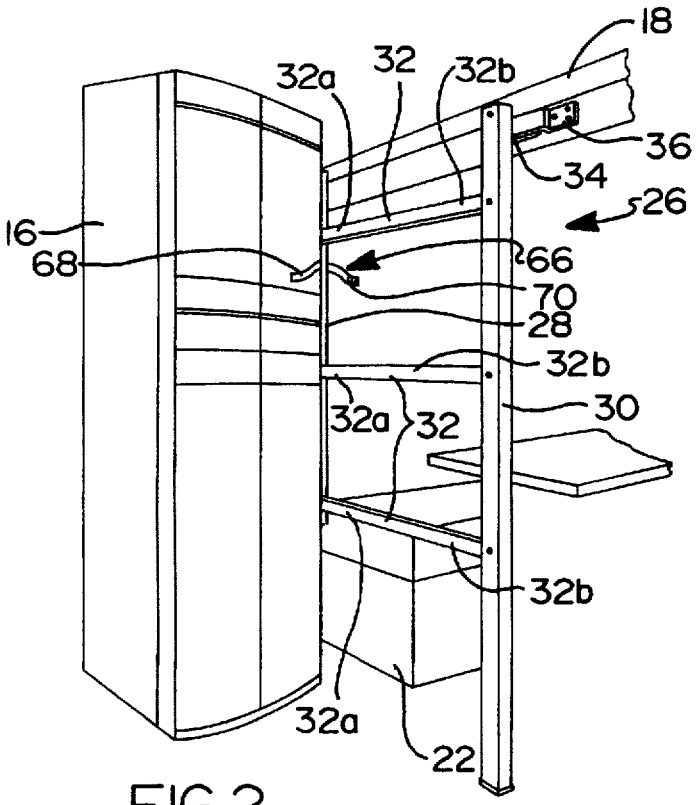
FIG 2

FIG 3
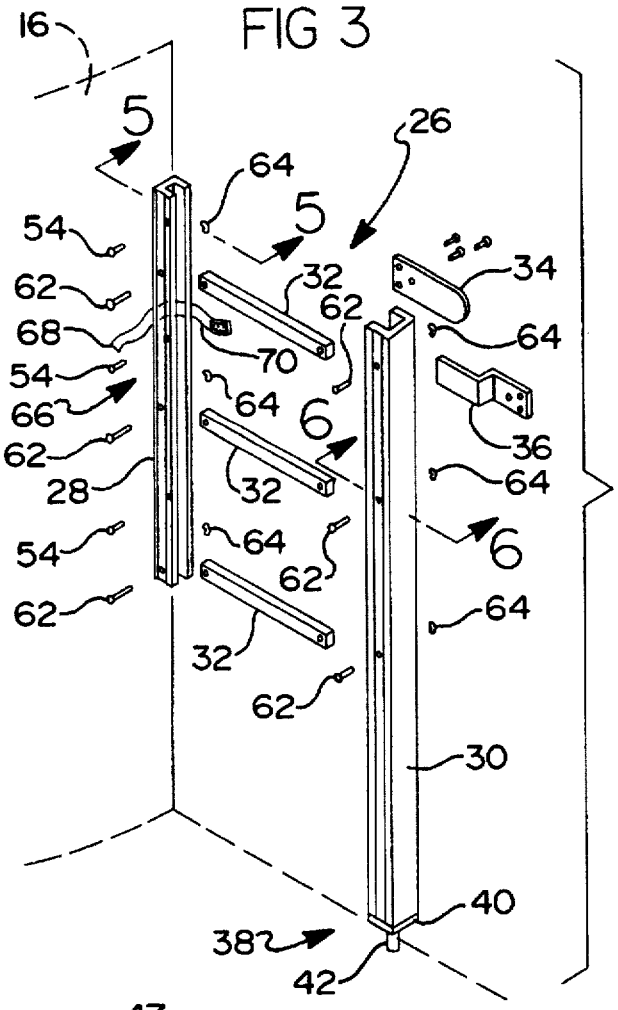
FIG 4
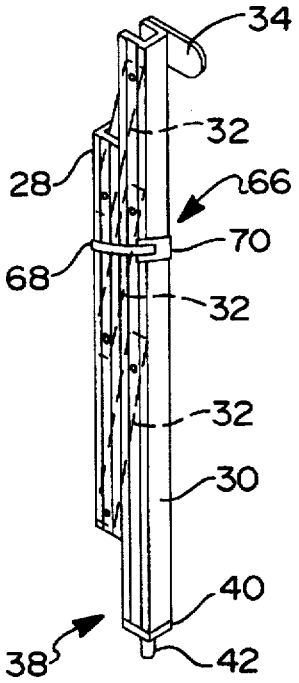
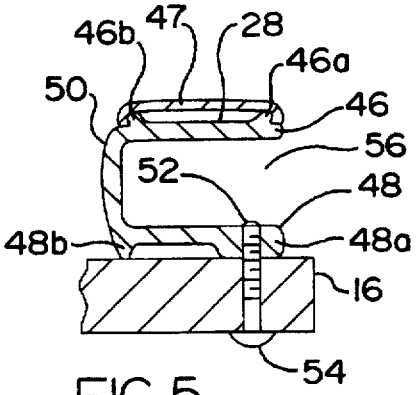
FIG 5
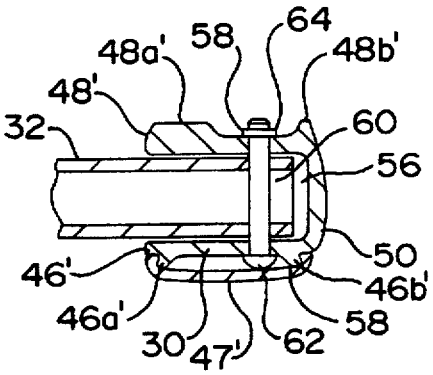
FIG 6
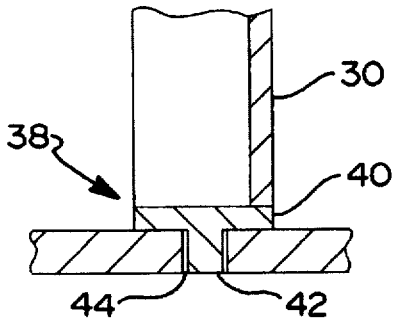
FIG 7

FOLDABLE LADDER

BACKGROUND AND SUMMARY OF THE INVENTION

This invention relates generally to a collapsible ladder assembly, and more particularly to a foldable ladder assembly adapted to the cab of an over-the-road truck for providing access to an elevated sleeping surface therein.

Over-the-road trucks or long-haul tractor trailers have long been designed with extended cab areas into which beds may be placed so that the drivers of these types of vehicles have a place to sleep or relax during breaks in driving. While these cabs are often designed to include one or two such beds, the cab is also frequently the driver's home for a long period of time. Thus, it is important to create as much room for movement within the truck cab and to create as much storage space within the cab for keeping the driver's belongings or other items. Therefore, the various comfort features which are utilized in the cab must be compactly and conveniently stored within the cab, to provide maximum useable cab space.

As mentioned above, over-the-road truck cabs are commonly equipped with an elevated sleeping surface or bunk bed which extends from a wall portion of the truck cab and is positionable between a stowed position and a use position. For example, U.S. Pat. No. 5,432,963, which is commonly owned by the assignee of the present invention and which is hereby expressly incorporated by reference, discloses one such truck cab mattress. However, because the sleeping surface is elevated substantially above the cab floor, ingress and egress is often difficult. When no other provisions are made to address this difficulty, drivers often times utilize any supporting surface located adjacent to the bed, such as a cabinet, table, or bench seat. These surfaces are often times not designed to support such a loading condition and thus may break as a result of the improper use thereof.

The present invention is directed to a foldable ladder assembly which is secured to a side wall portion of the vehicle cab or a cabinet located therein and is positionable between a compact, collapsed position wherein the ladder is stowed vertically and an extended use position wherein the ladder is supported from the vehicle floor and coupled to the bunk bed, thereby providing a stable ladder assembly for facilitating ingress and egress from the bunk bed. The ladder assembly includes a short vertical wall ladder rail secured to a vertical surface within the vehicle cab and a long vertical support ladder rail pivotally interconnected to the wall ladder rail by a plurality of ladder rungs. The vertical support ladder rail is pivotally positionable with respect to the vertical wall ladder rail from a collapsed position wherein the pair of vertical ladder rails are directly adjacent one another to a use position wherein the vertical ladder rails are spaced apart from one another by the ladder rungs. The present invention further includes a latching strap for securing and maintaining the ladder assembly in the stowed position and a latching mechanism for stabilizing the ladder assembly when in the extended use position.

An object of the present invention is to provide a collapsible folder assembly for use in an over-the-road vehicle which can be conveniently stowed within a minimum amount of space and which is quickly and easily moved from the stowed position to a use position and vice a versa.

Another object of the present invention is to provide a stabilized ladder for facilitating ingress and egress to and from an elevated sleeping surface within a vehicle cab.

These and other advantages and features of the present invention will become apparent to those skilled in the art from the following written description and appended claims taken in conjunction with the accompanying drawings.

BRIEF DESCRIPTION OF THE DRAWINGS

FIG. 1 is a schematic representation of the interior portion of a over-the-road truck cab showing the relative location of the various interior components including the present invention;

FIG. 2 is a perspective view showing the ladder assembly of the present invention secured to a cabinet portion and extended into the use position for facilitating access to an elevated sleeping surface;

FIG. 3 is an exploded perspective view of the present invention shown in the extended use position;

FIG. 4 is a perspective view of the present invention shown in a collapsed storage position;

FIG. 5 is a sectional view taken along line 5—5 of FIG. 3 showing the attachment of the ladder assembly to the cabinet assembly;

FIG. 6 is a sectional view taken along line 6—6 of FIG. 3 showing the pivotal connection between the adder rung and the support rail; and FIG. 7 is a side view of the foot portion of the ladder assembly illustrating the lower stabilization mechanism.

DETAILED DESCRIPTION OF THE PREFERRED EMBODIMENT

The present invention provides a stowable ladder assembly for facilitating access to an elevated sleeping surface and is adaptable to the interior of numerous types of vehicles such as over-the-road trucks, recreational vehicles, marine crafts, railroad cars, air crafts and the like. While the preferred embodiment relates to a collapsible ladder assembly adapted to a cab of an over-the-road truck, one will appreciate that the present invention is not so limited in application.

Referring to FIG. 1, a schematic representation of cab 10 of an over-the-road truck having numerous comfort features included therein is illustrated. More specifically, cab 10 includes driver seat 12 and passenger seat 14, a pair of cabinet assemblies 16 located behind driver seat 12 and passenger seat 14, a folding bunk assembly 18 operatively connected to a rear wall of cab 10 and positionable between a vertical storage position and a horizontal use position, table assembly 20 and bench seats 22 for providing a seating location within the rear portion of cab 10. Foldable ladder assembly 26 is secured to cabinet assembly 16 located behind passenger seat 14 and is operatively positionable between a storage position and a use position.

Folding ladder assembly 26 includes short wall ladder rail 28 which is vertically disposed and secured to a portion of cabinet 16 and long support ladder rail 30 which are interconnected by a plurality of ladder rungs 32. The length of ladder rungs 32 and the distance therebetween must meet published safety standards for ladder designs. As best seen in FIG. 1, an outboard portion 32*a* of ladder rungs 32 is unuseable because of the curved front design of cabinet assembly 16. Accordingly, ladder rungs 32 are much longer than might otherwise be required so as to provide a sufficiently sized useable inboard portion 32*b*, in addition to the unuseable outboard portion 32*a*. Referring now to FIG. 2, wall ladder rail terminates at a point substantially above the floor, thereby providing adequate clearance for bench seat 22. Folding ladder assembly 26 further includes support tab 34 secured to an upper portion of support ladder rail 30 and extending outwardly therefrom in a direction away from wall ladder rail 28. Support bracket 36 is secured to a frame portion of folding bunk assembly 18 and further includes a flange portion 38 spaced apart from folding bunk assembly 18 for defining a gap which receives support tab 34 when folding ladder assembly 26 is positioned in the extended use position. Foot assembly 38 is located at a bottom portion of support ladder rail 30 and includes plate 40 having pin 42 extending downwardly therefrom. As best seen in FIG. 7, aperture 44 is formed within a floor board portion of vehicle cab 10 for receiving pin 42 when the ladder is in an extended use position.

Referring now to FIGS. 3 and 5, wall ladder rail 28 is generally U-shaped in cross-section having a pair of laterally extending flanges 46 and 48 interconnected by web 50. As best seen in FIG. 5, laterally extending flange 46 has a pair of beads **46*a*, 46*b* formed on an outer surface therefor for securing decorative trim strip 47 thereto. Likewise, laterally extending flange 48 has a pair of bead 48*a*, 48*b* portions formed thereon for appropriately spacing wall ladder rail 28 from a wall portion of cabinet 16. In addition, aperture 52 is formed through laterally extending flange 48 for receiving threaded fastener 54 to secure wall ladder rail 28 to a wall portion of cabinet 16**.

Referring now to FIGS. 3 and 6, support ladder rail 30 is substantially similar to wall ladder rail 28 in cross-section. Accordingly, laterally extending flanges 46' and 48', as well as web 50' are substantially identical to that found on wall ladder rail 28. Channel 56' is adapted to receive ladder rung 32 therein. Aperture 58 is formed through laterally extending flanges 46' and 48' and a corresponding aperture 60 is formed through ladder rung 32 for receiving pin 62 therethrough. Spring clip 64 is disposed on an end of pin 62 to retain it in its appropriate position. As such, ladder rung 32 is pivotally connected to support ladder rail 30. Likewise, as best seen in FIG. 3, the opposite end of ladder rung 32 is pivotally interconnected with wall ladder rail 28 by way of pin 62 and clip 64.

Referring now to FIGS. 2–4, folding ladder assembly 26 further includes retention mechanism 66 for maintaining folder ladder assembly 26 in its collapsed, storage position. More specifically, retention mechanism 66 includes overlapping straps 68 and 70 secured at a first end to wall ladder rail 28 and having corresponding hook and fastener material (i.e., VELCRO® or the like) disposed on an end opposite thereof. Accordingly, when ladder assembly 26 is positioned in its collapsed storage position, straps 68 and 70 may be overlapped to retain and secure ladder assembly 26 in this position.

With continued reference to FIGS. 2–4, the operation of ladder assembly 26 will now be described. As previously discussed, wall ladder rail 28 is secured to a wall portion of cabinet assembly 16. Support ladder rail 30 is pivotally connected to ladder rungs 32 such that it is adapted to be positionable in an extended use position as best seen in FIG. 2. In this position, ladder rungs 32 are substantially horizontally oriented and operate to laterally space wall ladder rail 28 from support ladder rail 30. Foot assembly 38 disposed on a bottom portion of support ladder rail 40 engages aperture 44 for stabilizing and securing the bottom portion of support ladder rail 30. Similarly, support bracket 34 is captured between a frame portion of folding bed assembly 18 and support bracket 36 for coupling ladder assembly 26 to folding bunk 18 to stabilize the upper portion of support ladder rail 30. As such, a substantially fixed ladder assembly is provided for facilitating ingress and egress of an elevated sleeping surface 18.

When it is desirable to stow foldable ladder assembly 26, support ladder rail 30 is manipulated upwardly such that it rotates about pins 62 relative to ladder rungs 32. In this manner, rungs 32 trace an arcuate path causing support ladder rail 30 to swing upwardly and towards wall ladder rail 28. Traversing this arcuate path, support ladder rail 30 comes into abutting engagement with wall ladder rail 28 so as to provide a substantially compact vertically stowed ladder assembly, as best seen in FIG. 4. During manipulation of support ladder rail 30, support tab 34 moves upwardly and away from support bracket 36, thereby uncoupling the upper portion of support rail 30 from folding bunk assembly 18. Similarly, upon arcuate movement of support ladder rail 30, pin 42 of foot assembly 38 is withdrawn from aperture 44 to uncouple the lower portion of support rail from a floor portion of cab 10. Folding ladder assembly 26 is maintained in the collapsed, stowed position by overlapping strap 68 with strap 70 to retain support ladder rail 30 in adjacent proximity to wall ladder rail 28. As best seen in FIG. 4, ladder rungs 32 are stowed within channel 56 and 56' defined by wall ladder rail 28 and support ladder rail 30.

While it is apparent that the preferred embodiments of the present invention disclosed are well calculated to provide the advantages and features above stated, it will be appreciated that the invention is susceptible to modifications, variations and change without departing from the proper scope or fair meaning of the subjoined claims.

We claim:

1. A folding ladder assembly for use in a vehicle cab to provide access to an elevated surface comprising:

a fixed ladder rail secured to a vertical wall;

a moveable ladder rail;

a plurality of ladder rungs interdisposed between said fixed ladder rail and said moveable ladder rail, each of said plurality of ladder rungs being pivotally interconnected to said fixed ladder rail and said moveable ladder rail to enable relative movement of said moveable ladder rail between a first position wherein the moveable ladder rail is directly adjacent said fixed ladder rail, and a second position wherein said moveable ladder rail is laterally spaced from said fixed ladder rail such that said plurality of ladder rungs provide a plurality of steps; and a ladder stabilizing mechanism including a lower stabilizer having a first member extending from a bottom portion of said movable ladder rail and a second member for receiving said first member for restricting movement of said bottom portion of said moveable ladder rail when the ladder assembly is in said second position, and an upper stabilizer having a tab fixedly secured to a top portion of said movable ladder rail and extending laterally away from said fixed ladder rail, and a bracket secured to a frame member and having a flange spaced apart from said frame member, said tab being captured between said frame member and said flange for restricting movement of said top portion of said moveable ladder rail when the ladder assembly is in said second position.

2. The folding ladder assembly of claim 1 wherein said lower stabilizer comprises:

said first member including a foot assembly secured to said bottom portion of said movable ladder rail and having a pin extending downwardly therefrom; and said second member including a ladder support surface having an aperture formed therein for receiving said pin when the ladder assembly is in said second position.

3. The folding ladder assembly of claim 1 wherein at least one of said fixed ladder rail and said movable ladder rail comprises a pair of beads extending along a length thereof, and wherein the folding ladder assembly further comprises a trim portion engaging said pair of beads.

4. The folding ladder assembly of claim 1 further comprising a retention mechanism engaging said fixed ladder rail and said movable ladder rail to maintain the ladder assembly in said first position.

5. The folding ladder assembly of claim 4 wherein said retention mechanism comprises a pair of straps, each strap having a first end interdisposed between said vertical wall portion and said fixed ladder rail and a second end including a fastener.

6. In combination a vehicle cab comprising a floor having an aperture formed therein, a vertical wall, and a horizontal frame elevated above said floor and a folding ladder assembly comprising a fixed ladder rail secured to said vertical wall, a movable ladder rail, a plurality of ladder rungs interdisposed between said fixed ladder rail and said movable ladder rail, each of said plurality of ladder rungs being pivotally interconnected to said fixed ladder rail and said movable ladder rail to enable relative movement of said moveable ladder rail between a first position wherein the movable ladder rail is directly adjacent said fixed ladder rail and a second position wherein said movable ladder rail is laterally spaced from said fixed ladder rail such that said plurality of ladder rungs provides a plurality of steps, an upper stabilizer including a tab fixedly secured to said movable ladder rail and extending laterally away from said fixed ladder rail, and a bracket secured to a top portion of said horizontal frame and having a flange spaced apart therefrom, said tab being captured between said horizontal frame and said flange when the ladder is in said second position, and a lower stabilizer including a foot assembly secured to a bottom portion of said movable ladder rail and having a pin extending downwardly therefrom and being received by said aperture when the ladder assembly is in said second position.

7. The combination of claim 6 wherein at least one of said fixed ladder rail and said movable ladder rail comprises a pair of beads extending along a length thereof, and wherein the folding ladder assembly further comprises a trim portion engaging said pair of beads.

8. The combination of claim 6 further comprising a retention mechanism engaging said fixed ladder rail and said movable ladder rail to maintain the ladder assembly in said first position.

9. The combination of claim 8 wherein said retention mechanism comprises a pair of straps, each strap having a first end interdisposed between said vertical wall portion and said fixed ladder rail and a second end including a fastener.

* * * * *